US011402165B1

(12) United States Patent
Besselink

(10) Patent No.: US 11,402,165 B1
(45) Date of Patent: Aug. 2, 2022

(54) RECOIL-OPERATED PISTOL

(71) Applicant: Bernard Christian Besselink, Churchill (AU)

(72) Inventor: Bernard Christian Besselink, Churchill (AU)

( * ) Notice: Subject to any disclaimer, the term of this patent is extended or adjusted under 35 U.S.C. 154(b) by 0 days.

(21) Appl. No.: 17/653,650

(22) Filed: Mar. 5, 2022

(30) Foreign Application Priority Data

Dec. 6, 2021 (AU) ..... 2021282383

(51) Int. Cl.
*F41A 5/04* (2006.01)
*F41A 3/66* (2006.01)
*F41A 3/86* (2006.01)

(52) U.S. Cl.
CPC *F41A 5/04* (2013.01); *F41A 3/66* (2013.01); *F41A 3/86* (2013.01)

(58) Field of Classification Search
CPC ..... F41A 3/04; F41A 3/06; F41A 5/04; F41C 3/00
See application file for complete search history.

(56) References Cited

U.S. PATENT DOCUMENTS 4,936,035 A 6/1990 Reese et al.
5,513,550 A 5/1996 Field
5,581,046 A * 12/1996 Weldle ..... F41A 3/86 89/196
6,112,636 A 7/2000 Besselink
8,037,805 B1 10/2011 Neroni
11,143,469 B2 10/2021 Lucansky
2008/0000129 A1 1/2008 Garavaglia
2016/0209145 A1* 7/2016 Wolf ..... F41A 5/04
2021/0018290 A1* 1/2021 Brown ..... F41A 5/04

FOREIGN PATENT DOCUMENTS

WO 2016/164679 A1 10/2016

* cited by examiner

*Primary Examiner* — J. Woodrow Eldred

(57) ABSTRACT

A recoil-operated pistol has an arrangement which lowers the barrel bore axis and reduces the effect of felt recoil on the user. The pistol has a frame having a handgrip adapted to receive a magazine and a slide mounted for alternating longitudinal movement. A barrel carrier is mounted for alternating longitudinal horizontal movement along the frame and has a barrel rotatably connected to it near its muzzle end. The axis of the barrel bore when in the position for firing is below the lips of the magazine. An actuating mechanism under the influence of the recoiling barrel carrier rotates the barrel upwards such that the breech end of the barrel moves upwards to allow a cartridge to be removed. The recoiling barrel carrier urges the slide rearwards to facilitate the extraction and feeding of cartridges.

8 Claims, 4 Drawing Sheets

RECOIL-OPERATED PISTOL

CROSS-REFERENCE TO RELATED APPLICATIONS

The present application is based upon and claims benefit of priority to Standard Patent Application No. 2021282383, filed in Australia on Dec. 6, 2021 and hereby incorporated by reference herein.

FIELD OF THE DISCLOSURE

This invention relates to self-loading pistols and more particularly to self-loading pistols of the recoil-operated type.

Self-loading pistols include semi-automatic pistols and automatic pistols in contrast to other types of pistols which do not self-load such as revolvers. Semi-automatic pistols require discrete trigger operations, and automatic pistols continue to fire while the trigger remains depressed.

Recoil-operated pistols receive the energy to operate their loading mechanism from the energy of recoil. In recoil-operated pistols, the recoil force drives a slidable superstructure rearward on a horizontal platform built into a frame to extract a spent cartridge case from the firing chamber and eject it from the pistol. The superstructure is then returned to the battery position by a return spring and is adapted to strip the succeeding round from a magazine and insert it into the firing chamber.

BACKGROUND OF THE DISCLOSURE

Self-loading pistols can be divided into a number of types such as pure blowback, delayed blowback, gas-operated, short-recoil-operated and long-recoil-operated.

With pure blowback pistols, the slidable superstructure consists only of a breech block slide. The slide is not locked to the barrel and the barrel is fixed to the frame. Immediately after firing, the recoil force starts to drive the slide rearwards commencing the extraction of the spent cartridge case. Thus, part of the extraction occurs during the high pressure period in the barrel. If the slide is too light with respect to the power of the cartridge, the case is extracted too soon and case rupture may result, leading to a failure of the loading cycle and possible injury to the user. As a result, the pure blowback type can only be used with low-powered cartridges since there is a practical upper limit to the mass of a slide. This type, however, is cheap to make and is quite common.

There are also a number of blowback pistols which use a gas retarding arrangement attached to the slide: gas-delayed blowback. These have a cylinder and piston arrangement using gas bled from the barrel which must be compressed for the breech block slide to move rearwards. This retards the motion of the breech block slide and buffers the stop of the breech block slide near the end of its travel. This system allows the use of cartridges with more power than is possible with pure blowback.

With delayed blowback pistols, the slidable superstructure comprises a breech block slide and a delaying mechanism such as with roller-delayed blowback. The delaying mechanism is based on mechanical leverage in order to magnify the effective recoiling mass of the superstructure for a short period, thus reducing the extent of extraction of the spent cartridge case during the high pressure period in the barrel. This system has rarely been used in pistols as it is more complex than a short-recoil-operated system but offers no great benefits.

Gas-operated pistols have a chamber and piston and a slidable superstructure comprising a breech block slide and locking mechanism. The slide is locked to the barrel and the barrel is fixed to the frame. The chamber is connected by a passage to the barrel bore. After firing, the projectile travels along the barrel and passes the entrance to the passage and some gas is bled into the chamber. The gas pressure drives the piston which unlocks the locking mechanism after the high pressure period has passed. After unlocking, the breech block slide starts its rearward motion and begins extraction of the spent cartridge case using the energy provided by the piston and the residual gas pressure in the barrel. After extraction, the spent cartridge case is ejected. The slide continues until full travel is reached. Since the case is not able to move relative to the barrel until the slide is disengaged from the barrel and the operation is not dependent on the mass of the slidable superstructure, this type is generally used for very powerful cartridges. However, the mechanism is considered to be too complex for cartridges which can be catered for by short-recoil-operation.

With short-recoil-operated pistols, the slidable superstructure consists of a barrel, a breech block slide and a locking mechanism. Prior to the firing of the cartridge, the barrel is engaged to the breech block slide by the locking mechanism. After firing, the recoil force drives both the slide and barrel rearwards, but since they are locked in engagement, the extraction of the case has not started. After the high pressure period has passed, the barrel disengages from the slide. The disengaged barrel travels a relatively short distance and the breech opening comes to rest forward of the magazine, hence short-recoil. The breech block slide continues and begins extraction of the spent cartridge case using its kinetic energy and the residual gas pressure in the barrel. After extraction, the spent cartridge case is ejected. The slide continues until full travel is reached. Even though the cartridge case is not able to move relative to the barrel until the barrel is disengaged from the slide, the system is still dependent on the mass of the barrel and slide which also has practical limits. This type is generally used for medium power cartridges.

Long-recoil-operated pistols operate in a similar manner to short-recoil-operated pistols. However, the barrel and breech block slide are engaged for a longer distance, typically longer than the length of the cartridge, hence long-recoil. This system is generally considered to be obsolete. Historically, this system is heavy and complex, and has been used for powerful cartridges.

Since there is a practical limit to the mass of the barrel and slide for self-loading pistols, revolvers are generally used for the most powerful pistol cartridges.

It is desirable in a self-loading pistol or revolver to minimise felt recoil. Those pistol designs which may be able to handle very powerful cartridges have a high level of felt recoil.

When a cartridge is fired, there is a forward force on the bullet produced from the propellant gas pressure and an equal and opposite recoil force. This recoil force acts rearwardly along the axis of the barrel. The axis of the barrel of a self-loading pistol or revolver is located above the pivot point in the user's wrist and usually above the pivot point in the user's shoulder. On firing a self-loading pistol or revolver, a moment is produced about these points. These moments produce a rotation of the user's hand (muzzle flip) and an upward movement of the user's arm or arms (depending on stance). In addition, the slidable superstructure of a self-loading pistol moves backwards on the frame after firing and causes a shift in the centre of mass of the pistol.

The final effect which occurs in a self-loading pistol is the force from stopping the slidable superstructure at the end of its rearward travel. The felt recoil is the combination of the effects described above.

Felt recoil affects the accuracy of a user's shot. High felt recoil affects the first round hit probability because the user may flinch on firing in anticipation of the recoil. High felt recoil also reduces second round hit probability as it takes the user longer to readjust his aim for the second shot.

The distance of the barrel of a self-loading pistol from the pivot point in the user's wrist is a result of a number of factors.

Firstly, in most self-loading pistols the magazine containing the rounds of ammunition is located in the handgrip. The axis of the horizontal barrel bore must be at least the radius of the cartridge case above the lips of the magazine when in battery for loading to occur.

Secondly, since the magazine must present a round at a certain angle for stripping, the angle of the grip to the frame is determined by the angle of the magazine to the barrel bore axis. The dimensions of the grip are also determined by the magazine. The angle of the grip determines how far the wrist is able to rotate the hand of the user forward and downward. The further the hand of the user is rotated forward and downward, the shorter the distance between the barrel bore axis and the pivot in the user's wrist.

Thirdly, the size of the locking arrangements may determine how far the barrel must be positioned above the top of the magazine. The more bulky the locking arrangements, the higher the barrel must be above the top of the magazine and therefore the higher above the pivot point in the user's wrist: for example, a gas-operated pistol using a bolt head with rotating locking lugs.

The advantage of having a sharper handgrip angle is evident in target pistols. Target pistols tend to have a handgrip angle of about 60 degrees as compared to general self-loading pistols with an angle of about 75 degrees.

Some low-powered blowback target pistols used for rapid fire competition shooting have the magazine located forward of the trigger in order to lower the barrel to reduce muzzle flip. Essentially the entire pistol operating mechanism is moved forward substantially and the barrel is shortened. This approach is not practical for most pistols, and especially high-powered pistols, for many reasons.

The gas-operated pistol of U.S. Pat. No. 6,112,636 attempts to overcome the problems described above, such as felt recoil. It utilizes a barrel which has its bore axis located below the lips of the magazine and the barrel rotates upwards to unlock. However, it is gas-operated and it is difficult to design a suitable gas system to provide adequate gas pressure to operate the mechanism except in exceptionally long barrelled forms. Gas operation also has the attendant problem of fouling of the gas passage and chamber, and the requirement for cleaning the gas system. As well, the recommendation for gas-operated systems is to use jacketed ammunition. The use of plain lead bullets results in lead fragments shaving off the bullet and entering or blocking a gas port.

The recoil-operated pistol of U.S. Pat. No. 8,037,805 uses a slide on a inclined plane and a conventional rotating barrel locking mechanism in order to lower the bore axis. However, it appears only to be suitable for medium powered rounds. Furthermore, the use of a conventional rotating barrel locking system with a lengthened actuating lug appears to place a limit on how low the bore axis can be located.

The gas-delayed blowback pistol of U.S. Pat. No. 11,143,469 obtains a low barrel axis by utilizing a truncated breech block and having the gas chamber above the barrel: instead of below, as found on other designs. Normally when a round is stripped from the magazine, the following round is held down by the slide. In this pistol, there is a cavity in the rear of the slide such that the following round in the magazine sits higher than is conventional, and is pushed down by the truncated breech block when the slide travels rearwards. The round pops up again in front of the breech face when the breech block is fully rearward. This method allows the hand to move higher up the handgrip as the slide is shallower due to the cavity where a stripping rib would normally be. This pistol can only be used for medium powered rounds suitable for gas-delayed pistols; and which are also short enough to allow for the unconventional travel in the handgrip. It also has the fouling problems associated with gas-operated pistols.

A limitation with short recoil-operated pistols trying to utilise very powerful cartridges is the requirement to use a relatively strong recoil spring. In order to use very powerful cartridges in some contemporary pistol designs, a very powerful spring is used to retard the rearward movement of the slidable superstructure after firing. The very powerful spring can make it difficult for the operator to manipulate the slide in order to load a cartridge into the chamber. The slamming of the slide into components under the return force of a strong spring can cause damage in the long-term.

SUMMARY OF THE DISCLOSURE

In contrast to the prior art self-loading pistols, it is an object of the present invention to provide a recoil-operated pistol which reduces felt recoil by having a barrel mounted forward of the magazine in a slidable carrier such that the barrel bore axis is below the lips of the magazine.

The disclosed recoil-operated pistol comprises a frame having a handgrip adapted to be grasped by a user and a magazine well in the handgrip adapted to releasably receive a magazine. The magazine is adapted to be inserted into the magazine well and has lips to retain cartridges each consisting of a cartridge case and a projectile. The disclosed pistol has a barrel having a muzzle, a barrel bore and a firing chamber having a breech opening. A barrel carrier, adapted to carry the barrel, is slidably mounted for alternating longitudinal horizontal movement along the frame from a forward battery position to a rearmost position. The barrel carrier is located forward of the magazine for the entirety of the alternating longitudinal horizontal movement. Furthermore, the barrel carrier is located in the frame such that the axis of the barrel bore when in a horizontal position is below the lips of the magazine. A rotational joint means connects the barrel carrier with the barrel and provides for alternating rotational movement of the barrel in a vertical plane about a transverse axis. The barrel carrier has an upper opening to allow the barrel to rotate upwards from a horizontal position to a highest inclined position such that at the highest inclined position a cartridge case is able to be extracted from the breech opening.

The disclosed pistol has a trigger disposed in the frame, and a firing means disposed in the frame having a firing pin. The firing pin is able to fire a cartridge in the firing chamber after depressing the trigger to produce a high pressure period in the barrel. A breech closure means is formed at the rear end of the barrel carrier and is adapted to cover the breech opening when the barrel is in its horizontal position. Thus, the breech closure means prevents rearward movement of the cartridge case in the firing chamber during the high pressure period in the barrel. The breech closure means is adapted to allow passage of the firing pin to fire the cartridge in the firing chamber. A slide is slidably mounted for alternating longitudinal along the frame between a forward battery position and a rearward fully retracted position. A feed block is disposed on the slide and is adapted to extract a cartridge case from the firing chamber during a rearward movement of the slide, to strip a cartridge from the magazine and assist the cartridge into the firing chamber during its forward movement.

The disclosed pistol has an actuating means which acts to rotate the barrel in the vertical plane as a result of the movement of the barrel carrier. During a rearward movement of the barrel carrier, the actuating means urges the barrel to rotate upwards from its horizontal position in the barrel carrier to an inclined position allowing a cartridge case to be extracted from the breech opening. During a forward movement of the barrel carrier to the battery position, the actuating means urges the barrel to rotate downwards from the inclined position to its horizontal position. The disclosed pistol has a force transfer means adapted to transfer a force between the barrel carrier and the slide. Rearward movement of the barrel carrier transfers a force to the slide urging it rearwards; and forward movement of the slide transfers a force to the barrel carrier urging it forwards. At least one return spring urges the slide forwards, such as from a rearward position to the battery position. A barrel carrier retention means is adapted to retain the barrel carrier at a rearward position after a rearward movement of the barrel carrier where the upwards rotated barrel has its firing chamber available for the extraction of a cartridge case. The barrel carrier retention means is adapted to release the barrel carrier for forward movement once a cartridge has been assisted into the firing chamber by the feed block. It may be understood by a person skilled in the art that the disclosed pistol, perhaps uniquely, does not strictly fit into the conventional short-recoil nor long-recoil classes of recoil-operated pistols.

It may be preferred for the disclosed pistol to have a synchronizing means adapted to engage the slide and the barrel carrier such that translational rearward movement of the slide is substantially synchronized with the rearward movement of the barrel carrier until the barrel carrier is retained by the barrel carrier retention means and thereafter to disengage the slide and the barrel carrier to allow the slide to move independently to its rearmost position. With regard to the manual operation of the loading cycle, this preferred feature may provide a one-step process instead of a two-step process. The two-step process requires the barrel carrier to be moved manually rearward until retained by the barrel carrier retention means; and then the slide to be moved manually rearward to load a cartridge. Furthermore, the synchronizing means may prevent undesirable separation of the barrel carrier and slide as a result of particular mass and velocity dynamics after firing. Separation of the barrel carrier and slide may result in the breech opening being too far from the feed block after the barrel has rotated upwards and thus leading to a failure of extraction. A preferred synchronizing means may be a synchronizing arm which engages and disengages the slide and the barrel carrier. The synchronizing arm may have a rotational joint at one end and at the other end have an engagement means.

An embodiment of the disclosed pistol may include a locking means which assists in preventing relative longitudinal movement between the barrel and the barrel carrier during the high pressure period. The locking means may have at least one locking surface formed in the barrel carrier and at least one locking lug disposed on the barrel. The aforementioned rotational joint means may be sufficient to prevent relative longitudinal movement between the barrel and the barrel carrier during the high pressure period depending on its design and on the power of the cartridge. However, where the rotational joint means is not sufficient, the locking means may provide assistance. A lug may be disposed on the underside of the barrel or on the side of the barrel and a matching locking surface may be formed in the barrel carrier under the barrel or in its side respectively.

When the trigger of the disclosed pistol is depressed, the firing pin of the firing means is released and passes through a passage in the breech closure means to fire the cartridge in the firing chamber. High pressure propellant gases are produced. The projectile moves forward along the barrel bore during the high pressure period in the barrel. The gas pressure forcing the projectile forward provides a rearward acting force on the cartridge case. This force is transmitted to the barrel carrier. As a result, the barrel carrier moves horizontally rearwards: as does the barrel, since it is connected via the rotational joint means. The barrel and the barrel carrier move at the same translational speed. The rearward moving barrel carrier applies a force to the slide via the force transfer means to urge the slide rearwards from the forward battery position against the force of at least one return spring. After the projectile has exited the barrel and at a set distance of barrel carrier travel (the dwell distance), the actuating means starts to rotate the barrel upwards from its horizontal position. The breech end of the barrel begins to pass up through the upper opening in the barrel carrier. The barrel rotation continues under the influence of the actuating means and the rearward motion of the barrel carrier until the barrel carrier is stopped at its rearmost position. The barrel carrier retention means retains the barrel carrier at a rearward position. At this rearward position, the upwards rotated barrel is at an inclined position where it has its firing chamber available for the extraction of the cartridge case as it is clear of the breech closure means. At this point, the rearward travel of the slide is independent of the stationary barrel carrier. The slide continues its rearward travel due to its momentum. The feed block carried by the slide extracts the cartridge case from the firing chamber. The feed block continues rearward with the slide to a point where the cartridge case is ejected from the pistol. The slide continues until it reaches its rearward fully retracted position.

At least one return spring urges the slide and the associated feed block forward. As the feed block reaches the magazine, a cartridge is stripped from the magazine in the conventional manner. After further forward movement, the cartridge is assisted into the firing chamber by the feed block. The barrel carrier retention means releases the barrel carrier allowing it to move forward. The slide transfers a force to the barrel carrier via the force transfer means urging it forwards. During the forward movement of the barrel carrier, the actuating means urges the barrel to rotate downwards from the inclined position to its horizontal position in the barrel carrier where the breech closure means completely covers the breech opening. After the barrel is in its horizontal position, the barrel carrier continues on for a set distance to reach the battery position.

As already mentioned, the prior art use of recoil-operated arrangements in pistols is commonly known. However, persons skilled in the art have never utilized recoil operation to rotate a barrel upwards in order to make the round available for extraction.

An advantage of the present disclosure with respect to conventional recoil-operated pistols is that it provides a reduction in felt recoil. This is a result of the low barrel position and the higher hand position possible on the handgrip which produces a smaller moment relative to the user's hand than conventional recoil-operated pistols. Furthermore, the novel arrangement and positioning of the recoiling masses—barrel, barrel carrier and slide—allow for varying the distribution of mass in the pistol and adjusting the centre of gravity: particularly forward to reduce muzzle flip. The rotation of the barrel may also contribute a rotational inertia to the system which allows for a reduction in mass of recoiling parts. In addition, the disclosed pistol may allow the varying of the inclined angle of the barrel at feed within a certain practical range. This may allow for a further decrease in the angle of the handgrip without affecting the feed geometry and design of the magazine: the larger the barrel angle at feed, the steeper the handgrip angle possible.

An embodiment of the disclosure comprises a recoil-operated self-loading pistol in which the frame may comprise a lower portion having the handgrip and an upper portion having two longitudinal sides. The barrel carrier may further comprise two longitudinal sides each of which has a lower edge and an upper edge. The locking means may comprise two locking lugs formed on the underside of the barrel and two matching locking surfaces formed in the barrel carrier under the barrel. The rotational joint means may comprise a pair of discs disposed one on each side of the barrel and connected by two pins which pass under the barrel bore near the muzzle end through transverse holes through the barrel such that the discs do not rotate relative to the barrel. The discs may be located in circular holes in the sides of the barrel carrier such that the barrel and the barrel carrier are rotatably connected. It may be preferred that the axis of the rotational joint be below the axis of the barrel bore by a distance equal to or greater than the radius of the head of the cartridge to facilitate the upward rotation of the barrel with respect to the breech closure means.

In an embodiment, the actuating means may have a first inclined cam surface disposed in the frame under the barrel towards the muzzle end. An associated component may comprise a transverse roller located in the barrel carrier under the barrel toward the muzzle end where the transverse roller is constrained to move only in a substantially transverse vertical plane. Furthermore, the frame may carry another component of the actuating means comprising a transverse rod located in the frame under the barrel towards the breech end. An associated component may be a second inclined cam surface formed on the underside of the barrel. When the barrel carrier recoils, the second inclined cam surface may impact the transverse rod and may act to rotate the barrel upwards in the vertical plane for the initial portion of its rotation upwards. After the initial portion of the barrel rotation as described above, the transverse roller may contact the first inclined cam surface as a result of the barrel carrier moving rearwards. The first inclined cam surface may push the transverse roller vertically upwards against the underside of the barrel which may cause continued vertical rotation of the barrel until it reaches its upward limit. For the return travel, another component of the actuating means may comprise a forward transverse rod located in the frame above the barrel towards the muzzle end. A further associated component may be a curved cam surface formed on the top side of the barrel towards the muzzle end. On the return of the slide under the influence of the return spring, the barrel carrier may be urged forwards to its battery position and the curved cam surface on the inclined barrel may contact the forward transverse rod. The forward transverse rod may act to rotate the barrel downwards in the vertical plane for the final portion of its rotation to the horizontal position.

In an embodiment of the invention, the feed block may be rigidly mounted at the rear portion of the slide and may carry a left and a right extractor at its forward end. The face of the feed block may be adapted to accommodate the rear end of a cartridge case. A longitudinal rib may be formed on the underside of the feed block, the front end of which may be adapted to strip a cartridge held in the feed lips of the magazine. The magazine spring may push the cartridge upwards such that the rear end of the cartridge may slide up into the claws of the extractors.

The barrel carrier retention means may comprise a barrel carrier catch located on the inside of a longitudinal side of the frame and slidably mounted for substantially vertical alternating movement and biased to move upwards. The barrel carrier catch and the lower edge of a longitudinal side of the barrel carrier may be adapted to engage each other such that the barrel carrier is retained at a rearward position. A barrel carrier catch releaser may be disposed on the slide which may urge the barrel carrier catch downwards against the upward bias under the action of a forward moving slide. The barrel carrier and barrel carrier catch may then disengage from each other and the barrel carrier may be released for forward movement.

An embodiment of the disclosed pistol may include a synchronizing means as disclosed above having a synchronizing arm where the engagement means may comprise protrusions at the forward end of the arm adapted to engage recesses in the upper edge of the sides of the barrel carrier at the front. Furthermore, the rotational joint of the synchronizing arm may be located at the rear end of the arm and may be disposed in the slide.

The firing means of an embodiment may be a striker having a firing pin in the central area of its head and a pair of rearward extending arms each of which may have a cavity to house a coil spring used to thrust the striker forward after it has been released by a sear. When the striker is installed, the head may be located behind the barrel carrier and in front of the magazine and the arms may pass either side of the magazine. The trigger mechanism may be conventional single or double action. The firing means may also be achieved by other methods, such as hammers and strikers located in the frame or on the slide or feed block.

It should be clear to a person skilled in the art that there are other conventional means available to produce the required rotation of the barrel as described above and not require a change to the novel features of the invention: the barrel may be lifted and rotated by levers and links or by using pins and cam slots in various locations in the pistol of the invention. Furthermore, the barrel carrier retention means may be carried out using catches of various conventional forms known to a person skilled in the art. A person skilled in the art will understand how to implement other components such as travel stops and ejectors.

It should be clear to a person skilled in the art that a self-loading pistol according to the invention provides a novel means for reducing felt recoil to a user.

The dimensioning of all components of a firearm according to the invention will depend on the materials used and would be clear to a person skilled in the art. Although not all the alternative arrangements are shown or specifically described, all of them must be considered to be within the scope of the invention.

BRIEF DESCRIPTION OF THE DRAWINGS

The features and operation of the present invention will be apparent from a reading of the following detailed description and the appended claims and drawings. The embodiment shown in the drawings is only given by way of example and in no way limits the scope of the present invention. Labelled structures, elements or parts, which appear in more than one drawing, are labelled with the same number. The drawings are described as follows:

DETAILED DESCRIPTION OF THE DISCLOSURE

Figure 1:
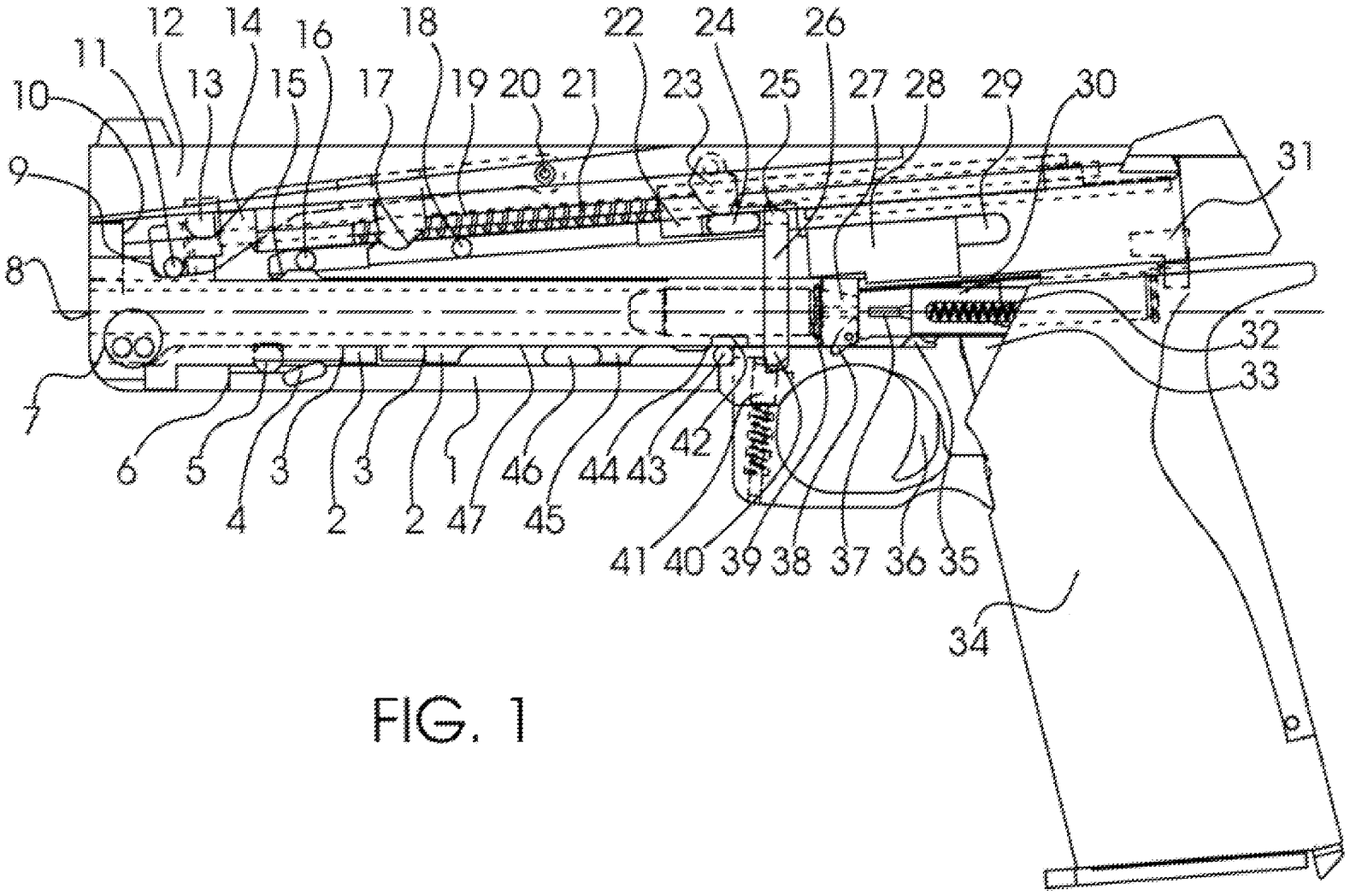
FIG. 1 represents a side elevation of a pistol according to the invention in battery, with the left side of the frame removed, and with the slide and barrel carrier in the battery position, barrel horizontal and the trigger not depressed.

As shown in FIGS. 1 to 8, the illustrated self-loading pistol embodying the present disclosure is of the recoil-operated type using a novel method of operation where the barrel rotates about a transverse axis to move the breech end upwards to uncover the mouth of the firing chamber, and allows for a lower barrel bore axis. The illustrated recoil-operated pistol has the overall configuration of conventional self-loading pistols.

The recoil-operated pistol illustrated in FIGS. 1 to 8 generally comprises a frame 1 which may have a handgrip 34 adapted to receive a magazine 33, an ejector 31 and an ejection port 48. There may be a firing mechanism having a trigger 36, a sear 35, a striker 30, a firing pin 37, and two striker springs 32. The striker 30 may have the firing pin 37 located in the central area of its head and a pair of rearward extending arms which may pass either side of the magazine 33. Each rearward extending arm may have a striker spring 32 disposed in a longitudinal cavity. A barrel 8 may have a rotational joint 7 near its muzzle to allow rotation of the barrel 8 in the vertical plane about a transverse axis. The rotational joint 7 may comprise a pair of discs joined by two pins which pass under the barrel bore through transverse holes in the barrel 8. The barrel 8 may be carried in the barrel carrier 47. The barrel 8 may be constrained from relative horizontal longitudinal movement by the rotational joint 7 which may be located in two circular holes one in each side of the barrel carrier 47 at its forward end. The barrel 8 may be engaged with barrel carrier 47 via two locking lugs 2 on the underside of the barrel 8 and locking surfaces 3 formed in the barrel carrier 47 under the barrel to further prevent relative horizontal separation during the high pressure period. A breech closure means 27 integral with the barrel carrier 47 may prevent substantial rearward movement of the cartridge case 39 during the high pressure period. There may be a rotably mounted striker separator 38 located in the lower edge of the breech closure means 27. The barrel hold down lug 45 which may be located on the underside of the barrel 8 may assist in holding the barrel 8 firmly down in battery by interacting with the barrel carrier second stop 46. The barrel carrier second stop 46 may prevent forward travel of the barrel carrier 47. The barrel carrier first stop 6 may prevent the barrel carrier 47 travelling further rearward. The barrel carrier 47 may be able to move longitudinally in guide recesses in each longitudinal side wall of the frame 1. The barrel carrier catch 26 may be slidably mounted on the inside of the frame 1 for substantially vertical alternating movement. The barrel carrier catch 26 may have a perpendicular protrusion 25 on the upper inside end and a perpendicular protrusion 40 on the lower inside end. There may be a spring and plunger 41 disposed in the trigger guard below the barrel carrier catch 26 which may provide an upwards bias force to the barrel carrier catch 26. There may be a retention notch 42 in the lower edge of a side of the barrel carrier 47.

A slide 12 may be slidably mounted substantially above the barrel 8 and barrel carrier 47 and may extend along the frame 1 from the front to the rear. The slide 12 may be mounted for alternating longitudinal movement in the frame 1 on an inclined plane by mating grooves and ribs in the frame 1 and slide 12. The inclined plane may have an angle of approximately 5 to approximately 10 degrees. The slide 12 may be prevented from being projected from the rear of the frame 1 during its rearward travel by the slide stop 24. The barrel carrier 47 may have a force transfer means in the form of the barrel carrier abutment 10 and a surface at the front end of the slide 12. There may be a barrel carrier catch releaser 23 located on the slide 12 which is rotatable about a transverse axis against a spring bias. The slide 7 may carry a synchronizing arm 14 located in the forward half of the slide 12. The synchronizing arm 14 may have a rotational joint 20 at its rear end disposed in the slide 12 and horizontal protrusions 11 at its forward end which may engage recesses 9 in the top front of the barrel carrier 47. The synchronizing arm 14 may also have a cam surface 17 which may contact the transverse pin 18 to urge the synchronizing arm 14 upwards at the time of disengagement from the barrel carrier 47. The slide 12 may carry the feed block 29 in its rear half. The feed block 29 may have an extractor 28 on each side to engage the cartridge case 39 for extraction and insertion and may have a longitudinal rib on its underside to strip a cartridge from the magazine 33.

There may be a spring holder 22 disposed in a cavity in the slide 12 in its rear half. The forward end of the spring holder 22 may have a step to engage with the slide stop 24. The body of the spring holder 22 may have a cavity for most of its length to accommodate a coil return spring 21. The return spring 21 may be mounted around a spring rod 19. The spring rod 19 (about two-thirds the length of the pistol) may have a spring rod end 13 fixed in the slide 12. The other end of the spring rod 19 may pass through a hole slightly larger than the diameter of the spring rod 19 in the rear end of the spring holder 22. One end of the coil return spring 21 may abut the spring rod end 13: the other end of the return spring 21 may abut the inside end of the spring holder 22. The spring holder 22 may remain in a relatively fixed position to the frame 1 while the slide 12 may be moving. This arrangement may produce a spring force between the slide 12 and the frame 1.

The actuating means may comprise a transverse rod 43 located in the frame 1 under the rear end of the barrel carrier 47; the angled surface 44 on the underside of the barrel 8; the roller 5 slidably mounted for vertical travel in the barrel carrier 47 and located under the barrel 8; an inclined cam surface 4 disposed on the frame under the barrel 8 and located to the rear of the roller 5; the forward transverse rod 16 located above the forward end of the barrel 8; and the cam surface 15 formed on the top side of the barrel 8. When the barrel 8 is in the battery position, the forward transverse rod 16 and the cam surface 15 may be substantially in contact in order to keep the barrel down in the battery position.

As shown in FIGS. 1 to 8, the disclosed pistol differs to conventional recoil-operated pistols in that it has a novel method of operation where the barrel rotates upwards for extraction of a cartridge to allow for a lower barrel bore axis.

Figure 2:
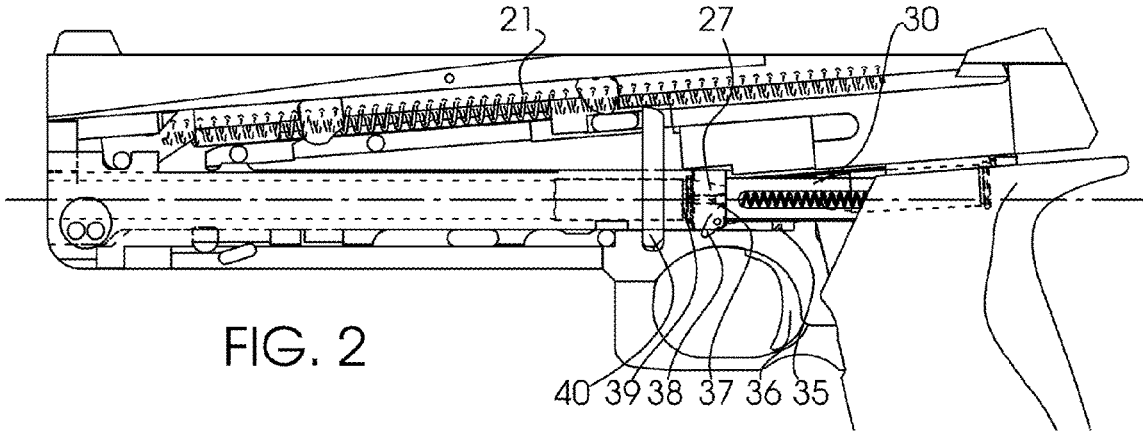
FIG. 2 represents a partial side elevation of a pistol according to the invention immediately after firing, with the left side of the frame removed, and with the slide and barrel carrier in the battery position, and barrel horizontal: the trigger is depressed and the striker is released.
Figure 3:
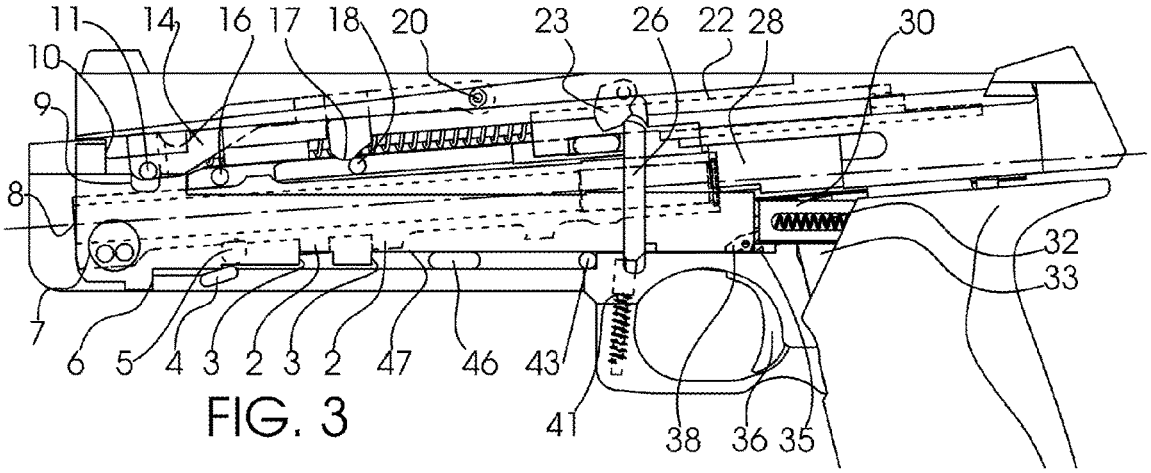
FIG. 3 represents a partial side elevation of a pistol according to the invention with the barrel fully rotated upwards, the slide and barrel carrier in contact but disengaged after firing, with the left side of the frame removed, and with the barrel carrier fully rearward.
Figure 4:
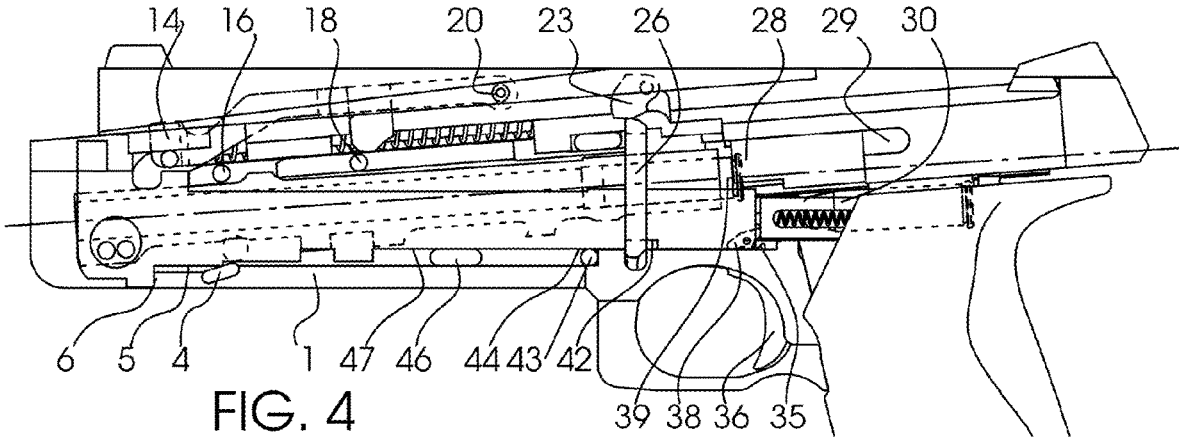
FIG. 4 represents a partial side elevation of a pistol according to the invention with the slide and barrel carrier disengaged, and a cartridge case partially extracted, with the left side of the frame removed, and with the barrel carrier fully rearward.
Figure 5:
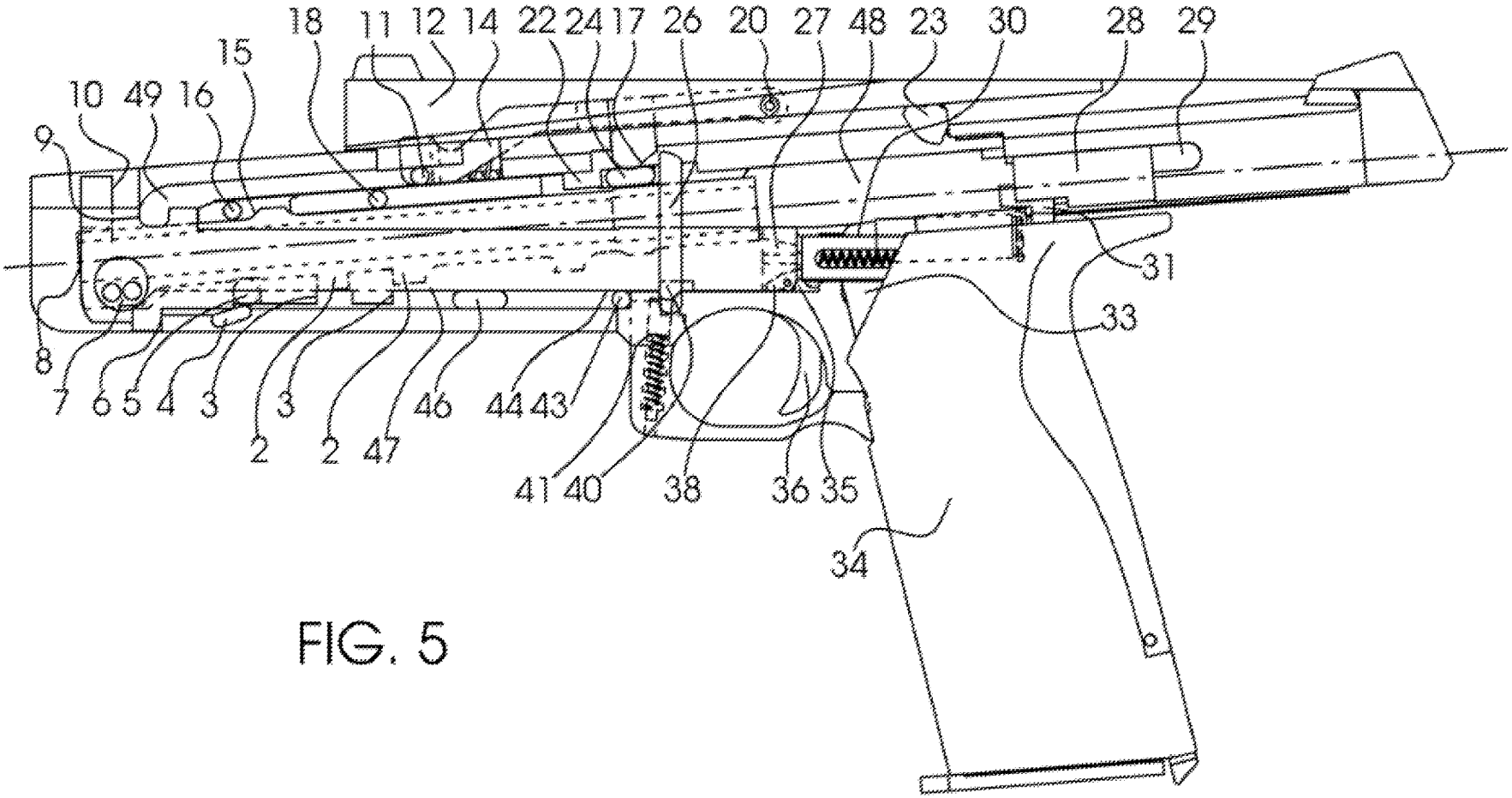
FIG. 5 represents a side elevation of a pistol according to the invention with the slide in the fully retracted position, with the left side of the frame removed, the barrel fully rotated upwards and the barrel carrier retained rearward after a cartridge case has been extracted.
Figure 6:
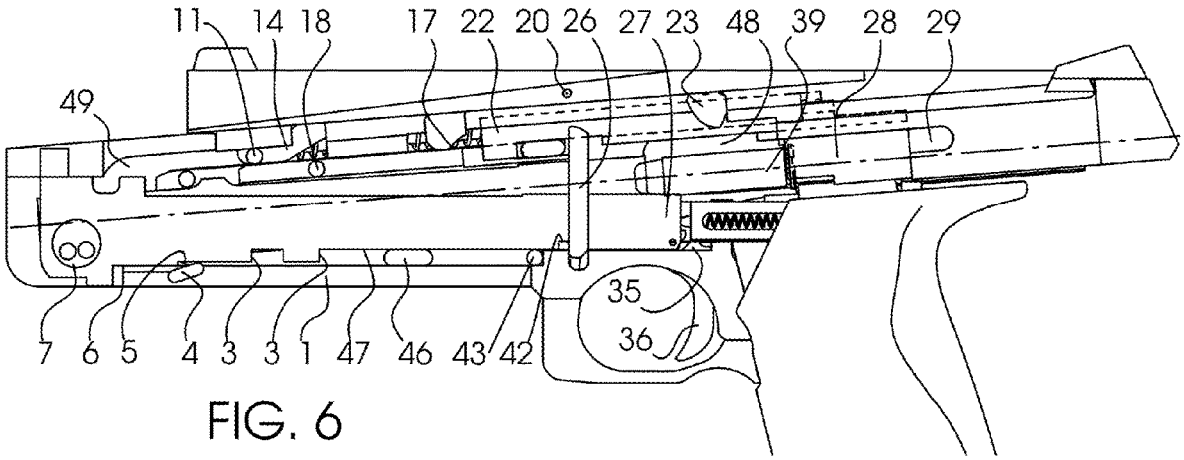
FIG. 6 represents a partial side elevation of a pistol according to the invention with a cartridge stripped from the magazine and feeding into the firing chamber, with the left side of the frame removed, and with the slide moving forward and trigger released.

The general operation of a pistol according to the invention may be as follows. When the trigger 36 is depressed, the sear 35 may release the striker 30. The firing pin 37 may pass through a hole in the breech closure means 27 to fire the cartridge, as shown in FIG. 2. During the high pressure period after firing, the barrel 8 may be prevented from separating from the barrel carrier 47 via locking lugs 2 and the rotational joint 7. The forward transverse rod 16 and the hold down lug 45 may prevent the barrel 8 from jumping upwards as a result of the initial impulse from the recoil. The recoil force acting through the base of the cartridge case 39 may urge the barrel carrier 47 rearwards and, via carrier abutment 10, the slide 12 may also move rearwards. The synchronizing arm 14 may prevent the slide 12 separating substantially from the barrel carrier 47 before the cartridge case 39 may be engaged by the extractors 28, due to the interaction of the protrusions 11 and recesses 9. As the barrel carrier 47 continues rearwards, the striker separator 38 may be urged to rotate clockwise by means of a cam surface in the base of the frame 1. This may urge the lower tail end of the striker separator 38 upwards and the head to protrude from the rear vertical surface of the breech closure means 27 to urge the striker 30 rearwards. This may create a separation sufficient for the tip of the firing pin 37 to retract from the dent in the fired primer in the cartridge case 39. This may allow for easier rotation of the barrel 8 in the next phase of the cycle. As the barrel carrier 47 continues rearwards, after a set distance (the dwell distance) the first part of the actuation means may operate to rotate the barrel 8 upwards. The angled surface 44 on the underside of the barrel 8 may contact the transverse rod 43 located in the frame 1 and urge the rear end of the barrel 8 upwards. At this point, the hold down lug 45 has been disengaged from the barrel carrier second stop 46 and the cam surface 15 is not in contact with the forward transverse rod 16 such that the barrel 8 may be free to rotate upwards. As the barrel carrier 47 continues further rearwards, the roller 5 may be acted on by the ramp surface 4 to continue the rotation of the barrel 8 upwards. The feed block 29 may move rearwards in unison with the slide 12 as it is rigidly fixed to the slide 12. As the barrel carrier 47 and slide 7 continue to move rearwards, the barrel 8 may continue to rotate upwards by the force imposed by the roller 5. When the base of the cartridge case 39 is about 50% exposed above the top edge of the breech closure means 27, the rim of the cartridge may begin to move up into the claws of the extractor 28 on the right side of the feed block 29 and the extractor 28 on the left side. When the barrel 8 is substantially at its uppermost position, the extractors 28 may be engaged with the rim of the cartridge case 39 such that the cartridge case 39 may be withdrawn from the chamber. The barrel carrier catch 26 may be able to engage the retention notch 42 in the barrel carrier 47 via the perpendicular protrusion 40 and due to the spring force from the spring and plunger 41. The barrel carrier 47 and slide 12 may continue in their motion rearwards together, as the retention notch 42 is adapted to allow this, and the cam surface 17 on the synchronizing arm 14 may contact the transverse pin 18 urging the synchronizing arm 14 to rotate upwards. As a result, the horizontal protrusions 11 on the left and right sides of the synchronizing arm 14 may move upwards to disengage from each of the two recesses 9 in the top front of the barrel carrier 47. Prior to this, the barrel carrier 47 may have urged the striker 30 rearward to enable it to engage with sear 35. The slide 12 may now be free to continue rearwards independently of the barrel carrier 47, as shown in FIG. 3. The horizontal protrusions 11 on the synchronizing arm 14 may be guided via a transition space 49, as shown in FIGS. 5 and 6, and may be able to travel rearwards in the grooves in the frame 1 which are also used for the guide ribs of the slide 12. As the slide 12 continues rearwards, the barrel carrier catch releaser 23 may pass over the perpendicular protrusion 25 on the upper inside end of the barrel carrier catch 26. The perpendicular protrusion 25 may contact the back face of the barrel carrier catch releaser 23 to rotate it clockwise (forwards) against the force of a spring so that it may eventually pass over the protrusion 25, as shown in FIGS. 3 and 4. The barrel carrier catch 26 may thus be able to remain in engagement via the retention notch 42 to hold the barrel carrier 47 and to stop it from moving forward. Once clear of the protrusion 25, the barrel carrier catch releaser 23 may rotate anticlockwise (rearwards) urged by its spring to its downward position. The cartridge case 39 may be withdrawn from the firing chamber by the extractors 28 as the slide 12 continues rearwards, as shown in FIG. 4. After being withdrawn from the chamber, the spent cartridge case 39 may pass above the lips of the magazine 33 until it may contact the ejector 31. The ejector 31 may eject the cartridge case 39 from the pistol through the ejection port 48, as shown in FIGS. 5 and 6. The slide 12 may stop at its rearmost position after contacting the slide stop 41, as shown in FIG. 5.

Figure 7:
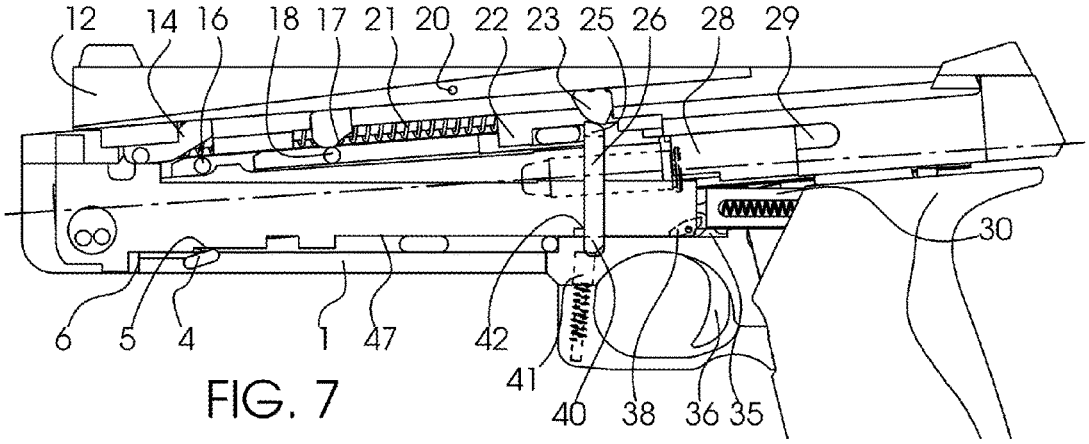
FIG. 7 represents a partial side elevation of a pistol according to the invention with the barrel carrier released and having a cartridge in the firing chamber, with the left side of the frame removed, and with the slide moving forward but not yet in contact with the barrel carrier.
Figure 8:
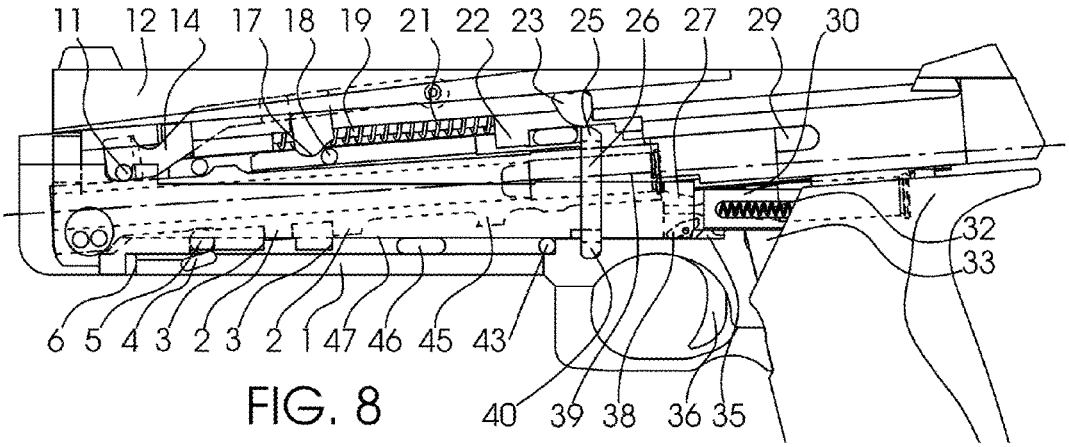
FIG. 8 represents a partial side elevation of a pistol according to the invention with a cartridge fully chambered with the barrel up, with the left side of the frame removed, and with the slide moving forward in contact with the barrel carrier.

After the slide 12 stops at its rearmost position, the return spring 21 may urge the slide 12 and feed block 29 forward. As the feed block 29 reaches the magazine, the succeeding round may be stripped from the magazine in the usual manner. The rim of the cartridge may be pushed up into the claws of the extractors 28 from the magazine. The round may be inserted into the firing chamber while the barrel 8 is in a high position for loading, as shown in FIG. 6. In order to release the barrel carrier 47 prior to the cartridge being fully chambered, the barrel carrier catch releaser 23 may depress the barrel carrier catch 26 under the action of the forward moving slide 12. The barrel carrier catch releaser 23 may not rotate anticlockwise (rearwards) as its rear surface abuts a surface in the slide 12; as a result its profiled surface may be able to interact with the perpendicular protrusion 25 of the barrel carrier catch 26. The barrel carrier catch 26 may be pushed down until it is disengaged from the retention notch 42, as shown in FIG. 7. The front end of the slide 12 may contact the barrel carrier abutment 10 when the cartridge is fully chambered and the slide 12 may urge the barrel carrier 47 forward, as shown in FIG. 8. As a result, the barrel 8 may move forward and be rotated downwards when the cam surface 15 on the top of the barrel 8 contacts the forward transverse rod 16 mounted in the frame 1. The barrel carrier 47 may continue to move forward and the barrel 8 may be rotated further downwards until it reaches its horizontal position and the locking lugs 2 and the locking surfaces 3 are substantially in contact. The breech closure means 27 may cover the base of the cartridge case 39. The barrel carrier 47 may continue to move forward and the hold down lug 45 may engage the barrel carrier second stop 46 such that it holds the barrel 8 down in the horizontal position. The horizontal portion of the cam surface 15 may be in contact with the underside of the forward transverse rod 16. The barrel carrier 47 and slide 12 may stop their forward motion. The barrel 8 may be returned to the battery position and the operational cycle completed.

The invention is not intended to be limited to the specific form of the embodiment shown, which is presented for illustrative purposes only. Rather, it will be understood by those skilled in the art that the invention contemplates all of the variations and modifications coming within the scope of the claims.

What is claimed is:

1. A self-loading pistol of the recoil-operated type comprising:

a frame having a handgrip adapted to be grasped by a user;

a magazine well in the handgrip adapted to releasably receive a magazine;

a magazine adapted to be inserted into the magazine well wherein the magazine has lips to retain cartridges each consisting of a cartridge case and a projectile;

an assembly comprising:

a barrel having a muzzle, a barrel bore and a firing chamber having a breech opening;

a barrel carrier adapted to carry the barrel;

wherein the barrel carrier is slidably mounted for alternating longitudinal horizontal movement along the frame from a forward battery position to a rearmost position and is located forward of the magazine for the entirety of its said horizontal movement and such that the axis of the barrel bore when in a horizontal position is below the lips of the magazine;

a rotational joint means which connects the barrel carrier and the barrel and provides for alternating rotational movement of the barrel in a vertical plane about a transverse axis;

wherein the barrel carrier has an upper opening to allow the barrel to rotate upwards from a horizontal position to a highest inclined position such that at the highest inclined position a cartridge case is able to be extracted from the breech opening;

a trigger disposed in the frame;

a firing means disposed in the frame having a firing pin which is able to fire a cartridge in the firing chamber after depressing the trigger to produce a high pressure period in the barrel;

a breech closure means formed at the rear end of the barrel carrier adapted to cover the breech opening of the barrel when in its horizontal position such that the breech closure means prevents rearward movement of the cartridge case in the firing chamber during the high pressure period in the barrel and is adapted to allow passage of the firing pin to fire the cartridge in the firing chamber;

a slide which is slidably mounted for alternating longitudinal movement along the frame between a forward battery position and a rearward fully retracted position;

a feed block disposed on the slide adapted to extract a cartridge case from the firing chamber during a rearward movement of the slide and during a forward movement of the slide to strip a cartridge from the magazine and assist the cartridge into the firing chamber;

an actuating means which acts to rotate the barrel in the vertical plane as a result of a movement of the barrel carrier;

wherein during a rearward movement of the barrel carrier the actuating means urges the barrel to rotate upwards from its horizontal position in the barrel carrier to an inclined position allowing a cartridge case to be extracted from the breech opening and during a forward movement of the barrel carrier to the battery position the actuating means urges the barrel to rotate downwards from the said inclined position to its horizontal position;

a force transfer means adapted to transfer a force between the barrel carrier and the slide;

wherein rearward movement of the barrel carrier transfers a force to the slide urging it rearwards and forward movement of the slide transfers a force to the barrel carrier urging it forwards;

at least one return spring which urges the slide forwards; and a barrel carrier retention means adapted to retain the barrel carrier at a rearward position with an upwards rotated barrel and release the barrel carrier for forward movement once a cartridge has been assisted into the firing chamber by the feed block;

wherein the said rearward position is any position of the barrel carrier which allows the upwards rotated barrel to have its firing chamber available for the extraction of a cartridge case.

2. A self-loading pistol according to claim 1 further comprising a synchronizing means adapted to engage the slide and the barrel carrier such that translational rearward movement of the slide is substantially synchronized with the rearward movement of the barrel carrier until the barrel carrier is retained by the barrel carrier retention means and thereafter to disengage the slide and the barrel carrier to allow the slide to move independently to its rearmost position.

3. A self-loading pistol according to claim 2 wherein the actuating means comprises:

a first inclined cam surface disposed on the frame under the barrel;

a transverse roller located in the barrel carrier under the barrel wherein the said roller is constrained to move only in a substantially transverse vertical plane;

a forward transverse rod located in the frame above the barrel; and a cam surface formed on the top side of the barrel;

wherein during a rearward movement of the barrel carrier the transverse roller interacts with the first inclined cam surface to urge the barrel to rotate upwards and during a forward movement of the barrel carrier the forward transverse rod interacts with the said cam surface on the barrel to urge the barrel to rotate downwards.

4. A self-loading pistol according to claim 2 wherein the synchronizing means comprises a synchronizing arm adapted to engage the slide and the barrel carrier.

5. A self-loading pistol according to claim 4 wherein the actuating means comprises:

a first inclined cam surface disposed on the frame under the barrel;

a transverse roller located in the barrel carrier under the barrel wherein the said roller is constrained to move only in a substantially transverse vertical plane;

a forward transverse rod located in the frame above the barrel; and a cam surface formed on the top side of the barrel;

wherein during a rearward movement of the barrel carrier the transverse roller interacts with the first inclined cam surface to urge the barrel to rotate upwards and during a forward movement of the barrel carrier the forward transverse rod interacts with the said cam surface on the barrel to urge the barrel to rotate downwards.

6. A self-loading pistol according to claim 5 wherein the barrel carrier retention means comprises a barrel carrier catch biased to move in one direction and the barrel carrier catch and the barrel carrier are adapted to engage each other such that the barrel carrier is retained at its said rearward position.

7. A self-loading pistol according to claim 6 further comprising a locking means which assists in preventing relative longitudinal movement between the barrel and the barrel carrier during the high pressure period having at least one locking surface formed in the barrel carrier and at least one locking lug formed on the barrel.

8. A self-loading pistol according to claim 7 wherein the frame further comprises:

a lower portion having the handgrip;

an upper portion having two longitudinal sides;

the barrel carrier further comprises:

two longitudinal sides each of which has a lower edge and an upper edge;

the locking means comprises:

two locking surfaces formed in the barrel carrier under the barrel;

two locking lugs formed on the underside of the barrel;

the rotational joint means comprises:

a pair of discs disposed one on each side of the barrel;

two circular holes disposed one in each longitudinal side of the barrel carrier;

two pins;

two transverse holes through the barrel passing under the barrel bore;

wherein each of the two pins passes through each of the two transverse holes to connect each of the discs such that the discs do not rotate relative to the barrel and each of the pair of discs is located in each of the two circular holes in the barrel carrier such that the barrel and the barrel carrier are rotatably connected;

the actuating means further comprises:

a second inclined cam surface formed on the underside of the barrel;

a transverse rod located in the frame under the barrel;

wherein during a rearward movement of the barrel carrier the said second inclined cam surface interacts with the transverse rod to urge the barrel to rotate upwards and the said interaction occurs before the said roller interacts with the said first inclined cam;

the feed block is rigidly mounted at the rear portion of the slide and comprises:

a feed block face at the front end of the feed block adapted to accommodate the base of a cartridge case;

a pair of extractors one on each side of the feed block face;

a longitudinal rib formed on the underside of the feed block adapted to strip a cartridge held in the feed lips of the magazine;

the barrel carrier catch is located on the inside of a longitudinal side of the frame and slidably mounted for substantially vertical alternating movement and biased to move upwards;

wherein the barrel carrier catch and the lower edge of a longitudinal side of the barrel carrier are adapted to engage each other such that the barrel carrier is retained at its said rearward position;

the barrel carrier retention means further comprises a barrel carrier catch releaser disposed on the slide which urges the barrel carrier catch downwards against the said upward bias under the action of a forward moving slide;

wherein the barrel carrier and barrel carrier catch disengage from each other and the barrel carrier is released for forward movement;

the engagement means of the synchronizing arm comprises:

protrusions at the forward end of the said arm adapted to engage recesses in the upper edge of the said sides of the barrel carrier at the front;

the said rotational joint of the synchronizing arm is located at the rear end of the said arm and is disposed in the slide;

the force transfer means comprises:

a surface on the barrel carrier; and a surface on the slide;

wherein each surface is substantially in contact with each other when the barrel carrier and the slide are in the battery position.

* * * * *